US006345576B2

(12) United States Patent
Furutsuka

(10) Patent No.: US 6,345,576 B2
(45) Date of Patent: Feb. 12, 2002

(54) STENCIL SHEET DISCHARGING DEVICE OF STENCIL PRINTING MACHINE

(75) Inventor: Makoto Furutsuka, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/819,980

(22) Filed: Mar. 29, 2001

(30) Foreign Application Priority Data

Apr. 4, 2000 (JP) ..... 2000-102439

(51) Int. Cl.[7] ..... B41L 47/14
(52) U.S. Cl. ..... 101/477; 101/114; 101/116
(58) Field of Search ..... 101/114, 116, 101/477, 479, 480

(56) References Cited

U.S. PATENT DOCUMENTS 4,846,057 A * 7/1989 Endo et al. ..... 101/120
5,323,706 A * 6/1994 Sugawara ..... 101/483
5,520,108 A * 5/1996 Hasegawa et al. ..... 101/121
5,713,274 A * 2/1998 Kawai et al. ..... 101/114
6,067,901 A * 5/2000 Takahashi ..... 101/114

FOREIGN PATENT DOCUMENTS

EP 0 836 950 4/1998
EP 0 992 358 4/2000

* cited by examiner

*Primary Examiner*—Ren Yan
(74) *Attorney, Agent, or Firm*—Kanesaka & Takeuchi

(57) ABSTRACT

A residual amount in the discharged stencil sheet box is displayed, a superior compression is performed against the discharged stencil sheet and many stencil sheets can be stored in the box. When the perforated stencil sheet 22 transferred by the feeding means 41 into the discharged stencil sheet box 42 is compressed by the discharged stencil sheet compression plate 43, the encoder 50 is utilized for detecting moving amount and compression force of the plate 43. When the pulse width of the pulse generated from the encoder 50 becomes a predetermined value, it is discriminated that the compression force with the plate 43 reaches a desired value, and the compression motor 44 is stopped. The number of pulses generated by the encoder 50 is counted to detect the moving position of the plate 43 and the residual amount in the box 42 is displayed in response to the moving position.

9 Claims, 8 Drawing Sheets

STENCIL SHEET DISCHARGING DEVICE OF STENCIL PRINTING MACHINE

BACKGROUND OF THE INVENTION AND RELATED ART STATEMENT

This invention relates to a stencil sheet discharging device of a stencil printing machine, and more particularly, a stencil sheet discharging device of a stencil printing machine in which the discharged stencil sheets fed into a discharged stencil sheet box are compressed by a discharged stencil sheet compression plate and filled in it.

As shown in FIG. 8A, in this type of stencil sheet discharging device in the prior art, a stencil sheet to be discharged is fed into a stencil sheet discharging box 2 by a discharged stencil sheet feeding operation under a state in which a discharging stencil sheet compression plate 1 is positioned at a home position. Upon completion of the discharged stencil sheet feeding operation, the discharged stencil sheet compression plate 1 descends as shown in FIG. 8B to start a compressing operation. At this time, a compression sensor (a photo-interrupter) 3 composed of a light emitting section and a light receiving section is changed from its light receiving state to a light shielding state by a compression sensor plate 5 arranged at a driving shaft 4. In addition, a torque is added to the discharged stencil sheet compression plate 1 from the driving shaft 4 through a coil spring (not shown).

Then, when the discharged stencil sheet compression plate 1 further descends and the compression sensor 3 is changed from the light shielding state to the light receiving state as shown in FIG. 8C, the compression motor is turned off. Then, after elapsing a specified period of time, the discharged stencil sheet compression plate 1 is lifted. At this time, as shown in FIG. 8C, fill-up sensor (a photo-interrupter) 6 comprised of a light emitting section and a light receiving section is shielded against light by a fill-up sensor plate 7.

In turn, as shown in FIG. 8D, when a stencil sheet discharged into the discharged stencil sheet box 2 fills up, the discharged stencil sheet compression plate 1 cannot descend by the discharged stencil sheet. Due to this fact, only the driving shaft 4 (the compression sensor plate 5) is rotated. Accordingly, even if the compression sensor 3 becomes a light receiving state again after it became a light shielding state, the fill-up sensor 6 is not shielded against light by a fill-up sensor plate 7. With such an arrangement as above, it is detected that the discharged stencil sheet box 2 is full of discharged stencil sheets.

The aforesaid stencil sheet discharging device for the stencil printing machine in the prior art can detect by the fill-up sensor 6 that the discharged stencil sheet box 2 is full of stencil sheets. However, this cannot detect the residual amount (vacant capacity) in the discharged stencil sheet box 2. Thus, this device shows a problem that the time required for filling the box with stencil sheets cannot be estimated.

In addition, there occurs occasionally that an operator desires to adjust the fill-up position in the discharged stencil sheet box 2 in reference to its state of use. However, a fixing position of the fill-up sensor 6 in the prior art stencil sheet discharging device for the stencil printing machine must be adjusted. Accordingly, this type of device has a problem that a fixing position of the fill-up sensor 6 cannot be easily adjusted.

Further, in the case that much amount of residual discharged stencil sheets is present in the box 2, all of the discharged stencil sheets is not compressed. Then, as the residual amount of discharged stencil sheet box 2 is reduced, a compression force is gradually applied to each of the discharged stencil sheets. Accordingly, it shows some problems that an appropriate compression force cannot be applied for each of the discharged stencil sheets and a superior compression cannot be carried out.

The present invention has been invented to solve the problems found in the prior art and it is an object of the present invention to reduce the number of sensors for use in sensing the compressing position or the compression force of the discharged stencil sheet compression plate and to reduce cost.

It is another object of the present invention to estimate a time when the box is full of stencil sheets by detecting the residual amount in the discharged stencil sheet box.

It is a still further object of the present invention to adjust a fill-up sensor fixing position in an easy manner.

It is a still yet further object of the present invention to apply a proper compression force for every discharged stencil sheet in the discharged stencil sheet box and to perform a superior compression.

SUMMARY OF THE INVNETION

In order to accomplish the aforesaid objects, according to a first aspect of the present invention, there is provided a stencil sheet discharging device for a stencil printing machine comprising:

- a discharged stencil sheet compression plate 43 for use in compressing a discharged stencil sheet fed into a discharged stencil sheet box 42 within the discharged stencil sheet box 42;
- a driving means (a compression motor 44) for driving the discharged stencil sheet compression plate 43 and compressing the discharged stencil sheet within the discharged stencil sheet box 42;
- a compression force detecting means for sensing that a predetermined compression force is added to the discharged stencil sheet;
- a control means for stopping a compressing operation performed by the driving means 44 when a predetermined compressive force is detected by said compression force detecting means 50;
- a moving amount detecting means for detecting a moving amount of a discharged stencil sheet compression plate 43 when a predetermined compressive force is detected by said compression force detecting means; and
- a display means (a discharged stencil sheet amount display unit 94) for displaying a residual amount in the discharged stencil sheet box 42 in reference to a moving amount detected by the moving amount detecting means.

With this stencil sheet discharging device, it becomes possible to estimate a time in which the box is filled with the discharged stencil sheets due to the fact that a moving amount of the discharged stencil sheet compression plate 43 is detected and a residual amount in the discharged stencil sheet box 42 is displayed. In addition, it becomes possible to perform a superior compression and store much amount of discharged stencil sheets in the discharged stencil sheet box 42 due to the fact that every discharged stencil sheet is compressed with a predetermined compression force.

According to a second aspect of the present invention, there is provided a stencil sheet discharging device for a stencil printing machine comprising:

- a discharged stencil sheet compression plate 43 for use in compressing a discharged stencil sheet fed into a discharged stencil sheet box 42 within the discharged stencil sheet box 42;

a driving means (a compression motor 44) for driving the discharged stencil sheet compression plate 43 and compressing the discharged stencil sheet within the discharged stencil sheet box 42;

an encoder 50 for generating the number of pulses corresponding to the moving amount of the discharged stencil sheet compression plate 43;

a compression force detecting means for detecting a pulse width of pulse generated from the encoder 50 and detecting that a predetermined compression force is added to the discharged stencil sheet when said pulse width exceeds a predetermined value;

a control means for stopping a compressing operation performed by the driving means 44 when a predetermined compression force is detected by the compression force detecting means;

a moving amount detecting means for counting pulses generated from an encoder 50 until a predetermined compression force is detected by the compression force detecting means and detecting a moving amount of the discharged stencil sheet compression plate in response to the counted number of pulses; and a display means (a discharged stencil sheet amount display unit 94) for displaying a residual amount in the discharged stencil sheet box 42 in reference to a moving amount detected by the moving amount detecting means.

The invention according to a second aspect of the present invention utilizes one unit of encoder as a sensor for detecting either a compressing position or a compression force of the discharged stencil sheet compression plate as compared with the invention according to a first aspect of the present invention so as to reduce cost of the sensor.

As indicated in a third aspect of the present invention, there is provided a home position sensor 56 for use in sensing a home position of the discharged stencil sheet compression plate 43, the moving amount sensing means either resets or pre-sets the number of pulses to be counted when the home position sensor 56 detects the home position of the discharged stencil sheet compression plate.

Further, as indicated in a fourth aspect of the present invention, there is provided a setting means for setting a compression fill-up position of the discharged stencil sheet box 42, the display means 94 displays the residual amount in the discharged stencil sheet box 42 in response to the compression fill-up position set by the setting means and the moving amount detected by the moving amount detecting means. That is, it is possible to set the compression fill-up position in the discharged stencil sheet box 42 in an easy manner and further the display means 94 can display the residual amount in response to the set fill-up position.

As indicated in a fifth aspect of the present invention, said control means controls said driving means 44 so that said discharged stencil sheet compression plate 43 is operated to compress the discharged stencil sheet within said discharged stencil sheet box 42 until the predetermined compression force is detected by said compression force detecting means, said discharged stencil sheet compression plate 43 is stopped at the compressing position for a predetermined period of time in case where the predetermined compression force is detected by said compression force detecting means, and said discharged stencil sheet compression plate 43 is returned back to the predetermined waiting position, i.e. home position.

DETAILED DESCRIPTION OF THE PREFERRED EMBODIMENTS

Figure 1:
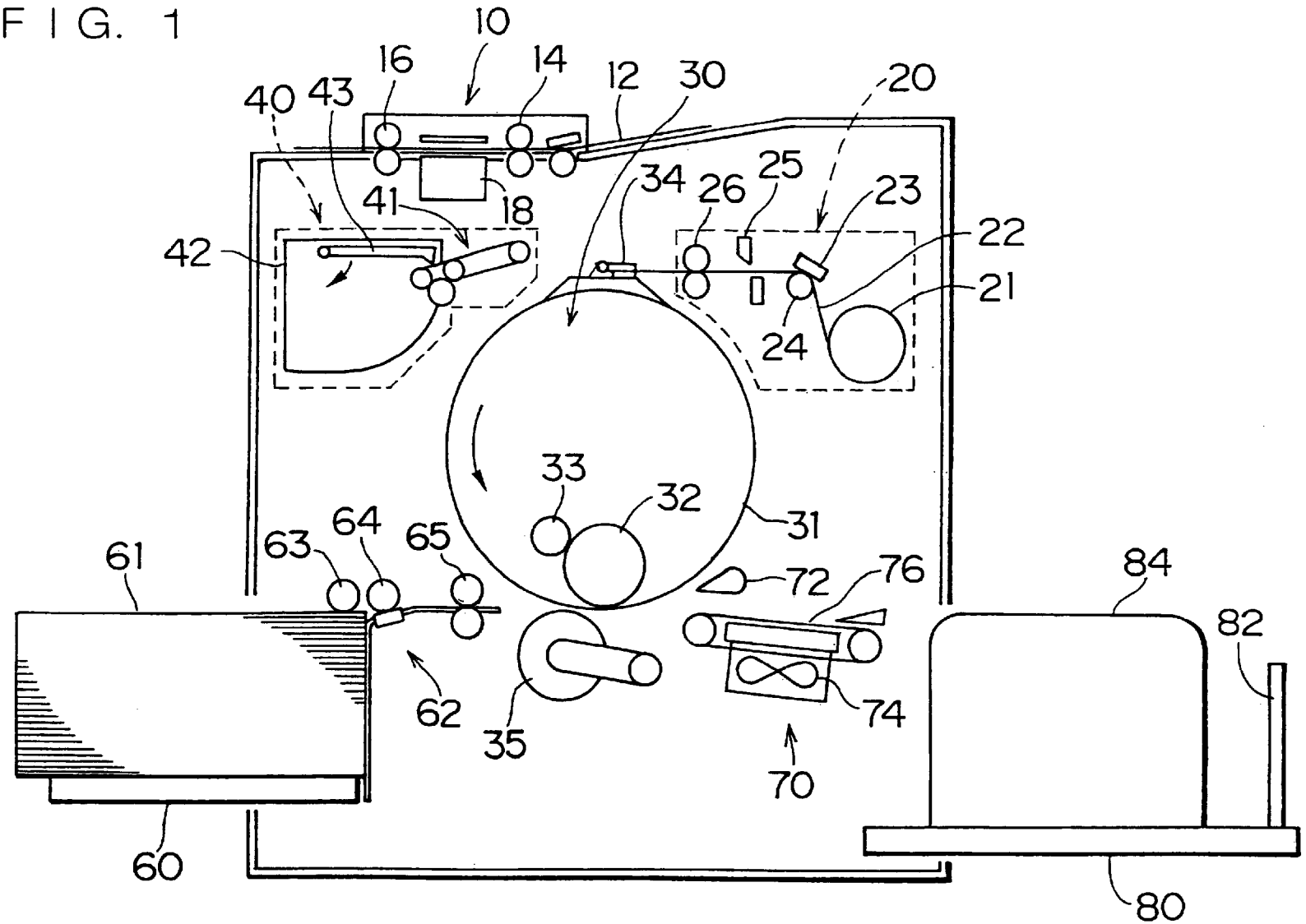
FIG. 1 is a front elevational view for schematically showing an inner structure of a stencil printing machine to which the stencil sheet discharging device of the present invention is applied.

Referring now to the accompanied drawings, some preferred embodiments of the stencil sheet discharging device of a stencil printing machine of the present invention will be described in detail. FIG. 1 is a front elevational view for schematically showing an inner structure of a stencil printing machine to which the stencil sheet discharging device of the present invention is applied.

As shown in FIG. 1, this stencil printing machine is mainly constituted by an original reading unit 10, a stencil making unit 20, a drum unit 30, a stencil sheet discharging unit 40, a sheet supply base 60, a sheet supply section 62, a sheet discharging section 70 and a sheet discharge base 80.

The original reading unit 10 has an original insertion port into which the original 12 is inserted. In addition, there are provided transfer rollers 14 for automatically transferring the original 12 and sheet discharging rollers 16. Further, there is provided a line image sensor 18 for use in reading the transferred original 12.

The stencil making unit 20 is constituted by a roll-like stencil sheet 21, a stencil sheet 22, a thermal head 23, a platen roller 24, a cutter section 25 and load rollers 26. The stencil sheet 22 is drawn out of the roll-like stencil sheet 21. The stencil sheet 22 supplied from the roll-like stencil sheet 21 is held between the thermal head 23 and the platen roller 24. Then, the platen roller 24 transfers the stencil sheet 22 while being rotated. The stencil sheet 22 is thermally perforated with heat generated by the thermal head 23. The thermal head 23 is made such that a plurality of heating elements are arranged in a direction crossing at a right angle with a transferring direction of the stencil sheet 22. Each of the heat generating operations of the heating elements is controlled in response to an image signal indicating the original 12 read by the original reading unit 10. With such an arrangement as above, the punching and perforation corresponding to the original 12 are performed at the stencil sheet 22.

A cutter section 25 and load rollers 26 are arranged at downstream side of the thermal head 23. The cutter section 25 cuts the perforated stencil sheet 22 for every perforated sheet. The load rollers 26 feed the extremity end of the stencil sheet 22 onto a printing drum 31 for every perforated sheet. In the case that the perforated stencil sheet 22 is set to the printing drum 31, the printing drum 31 waits at a position (a position shown in FIG. 1) where the clamp plate 34 comes over it. When the extremity end of the stencil sheet 22 is fed out to the position of the clamp plate 34 by the load rollers 26, the clamp plate 34 is closed. After this operation, the printing drum 31 is rotated to perform a winding of the stencil sheet 22 onto the printing drum 31. As the printing drum 31 is rotated by about ¾, the cutter section 25 cuts the stencil sheet 22.

The drum unit 30 is comprised of a printing drum 31, a squeezing roller 32 and a doctor roller 33. The squeezing roller 32 is arranged to be contacted with the inner circumferential surface of the printing drum 31. The doctor roller 33 supplies ink to the squeezing roller 32. At the drum unit 30, ink is supplied to the stencil sheet 22 wound to the surface of the printing drum 31. Then, the print sheet 61 is held between the printing drum 31 and the press roller 35. The press roller 35 is moved up and down in synchronous with a printing range at the surface of the printing drum 31 so as to press the print sheet 61 against the printing drum 31. Then, ink supplied to the stencil sheet 22 is transferred to the held print sheet 61. In this way, a printing is carried out.

The stencil sheet discharging unit 40 is comprised of a discharged stencil sheet feeding means 41, a discharged stencil sheet box 42 and a discharged stencil sheet compression plate 43. When the stencil sheet wound to the printing drum 31 is separated by a stencil sheet discharging claw (not shown), the separated stencil sheet 22 is transferred into the discharged stencil sheet box 42 by the discharged stencil sheet feeding means 41. After this operation, the discharged stencil sheet compression plate 43 is turned and the discharged stencil sheet 22 is compressed and stored. Details of the stencil sheet discharging unit 40 will be described later.

The sheet supply base 60 can be moved up and down by a driving device (not shown) in response to stacking thickness of the print sheets 61 set on the sheet supply base 60. In addition, the sheet supply base 60 is provided with a pair of right and left paper feeding fences (not shown) which can be manually moved in compliance with the width of the print sheet 61. The pair of right and left paper feeding fences are operated such that as one paper feeding fence is moved, the other paper feeding fence may also be moved in cooperation with the former paper feeding fence. With such an arrangement as above, the print sheets 61 are always set at the center of the sheet supply base 60.

A scraper 63, a pick-up roller 64 and timing rollers 65 and the like constitute the sheet supply section 62. The print sheets 61 on the sheet supply base 60 are fed one by one by the scraper 63 and the pick-up rollers 64 up to the timing rollers 65. The timing rollers 65 once stop the fed print sheet 61 and accurately transfer it in synchronization with operations of the printing drum 31 and the pressing roller 35. The scraper 63 and the pick-up roller 64 have an one-way clutch stored therein. Then, in the case that the print sheet 61 is transferred by the timing rollers 65, the scraper 63 and the pick-up roller 64 can be driven and rotated by the print sheet 61.

The sheet discharge section 70 is constituted by a separating claw 72, a suction fan 74 and a transfer belt 76 and the like. The print sheet 61 is peeled off from the printing drum 31 by the separating claw 72. The peeled-off print sheet 61 is adsorbed onto the transfer belt 76 by the suction fan 74. Then, it is discharged onto the sheet discharge base 80 by the transfer belt 76.

The sheet discharge base 80 has a stopper 82 and a pair of right and left paper discharging fences 84. The sheet discharge base 80 accepts the print sheet 61 discharged from the sheet discharge section 70 at a high speed by a stopper 82. In addition, the accepted print sheets 61 are aligned to each other by the stopper 82 and the pair of right and left paper discharging fences 84.

Figure 2:
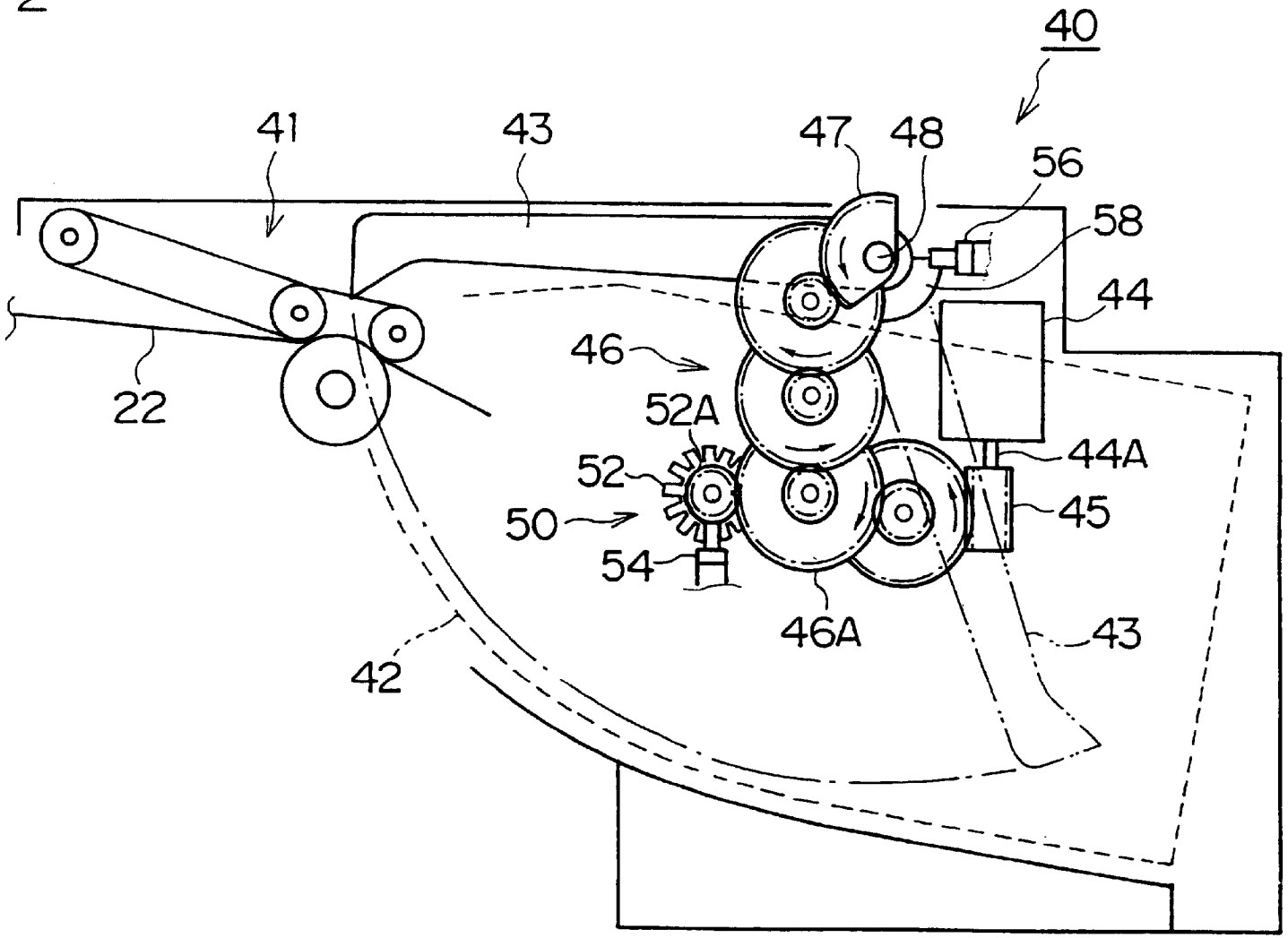
FIG. 2 is a view for showing a structure of the discharged stencil sheet unit shown in FIG. 1.

Then, the stencil sheet discharging unit 40 and its control system will be described in detail. FIG. 2 is a view for showing a structure of the stencil sheet discharging unit 40. As shown in this figure, the stencil sheet discharging unit 40 is mainly constituted by a discharged stencil sheet feeding means 41, a discharged stencil sheet box 42, a discharged stencil sheet compression plate 43, a compression motor 44, a deceleration gear mechanism 46 for transmitting a driving force from the compression motor 44 to the discharged stencil sheet compression plate 43, an encoder 50 and a home position sensor (an HP sensor) 56.

The discharged stencil sheet feeding means 41 may transfer the stencil sheet 22 separted from the printing drum 31 into the discharged stencil sheet box 42. The discharged stencil sheet compression plate 43 is arranged at the supporting shaft 48 having the fan-shaped gear 47 fixed therein and it can be turned around the supporting shaft 48. Then, the rotating and driving force of the compression motor 44 is transmitted from the worm 45 fixed to the driving shaft 44A to the supporting shaft 48 (i.e. the discharged stencil sheet compression plate 43) through the deceleration gear mechanism 46 and the fan-shaped gear 47.

The encoder 50 is constituted by a rotary slit 52 and a photo-interrupter 54. The rotary slit 52 has a gear 52A engaged with a gear 46A in the deceleration gear mechanism 46. Accordingly, when the compression motor 44 is rotated (the discharged stencil sheet compression plate 43 is turned), the rotary slit 52 is turned in correspondence with the former rotation. When the rotary slit 52 is turned, the photo-interrupter 54 may output the number of pulses corresponding to the number of slits of the rotary slit 52 passing through the photo-interrupter 54.

The HP sensor 56 may detect the home position of the discharged stencil sheet compression plate 43. The HP sensor 56 is constituted by the photo-interrupter for use in detecting an HP sensor plate 58 arranged at the supporting shaft 48. That is, in the case that the discharged stencil sheet compression plate 43 is present at the home position indicated in FIG. 2, the HP sensor 56 becomes a light receiving state (ON) by the HP sensor plate 58 to output a high-level signal. When the discharged stencil sheet compression plate 43 descends from the home position, the HP sensor 56 becomes a light shielding state (OFF) by the HP sensor plate 58 to output the low level signal.

Figure 3:
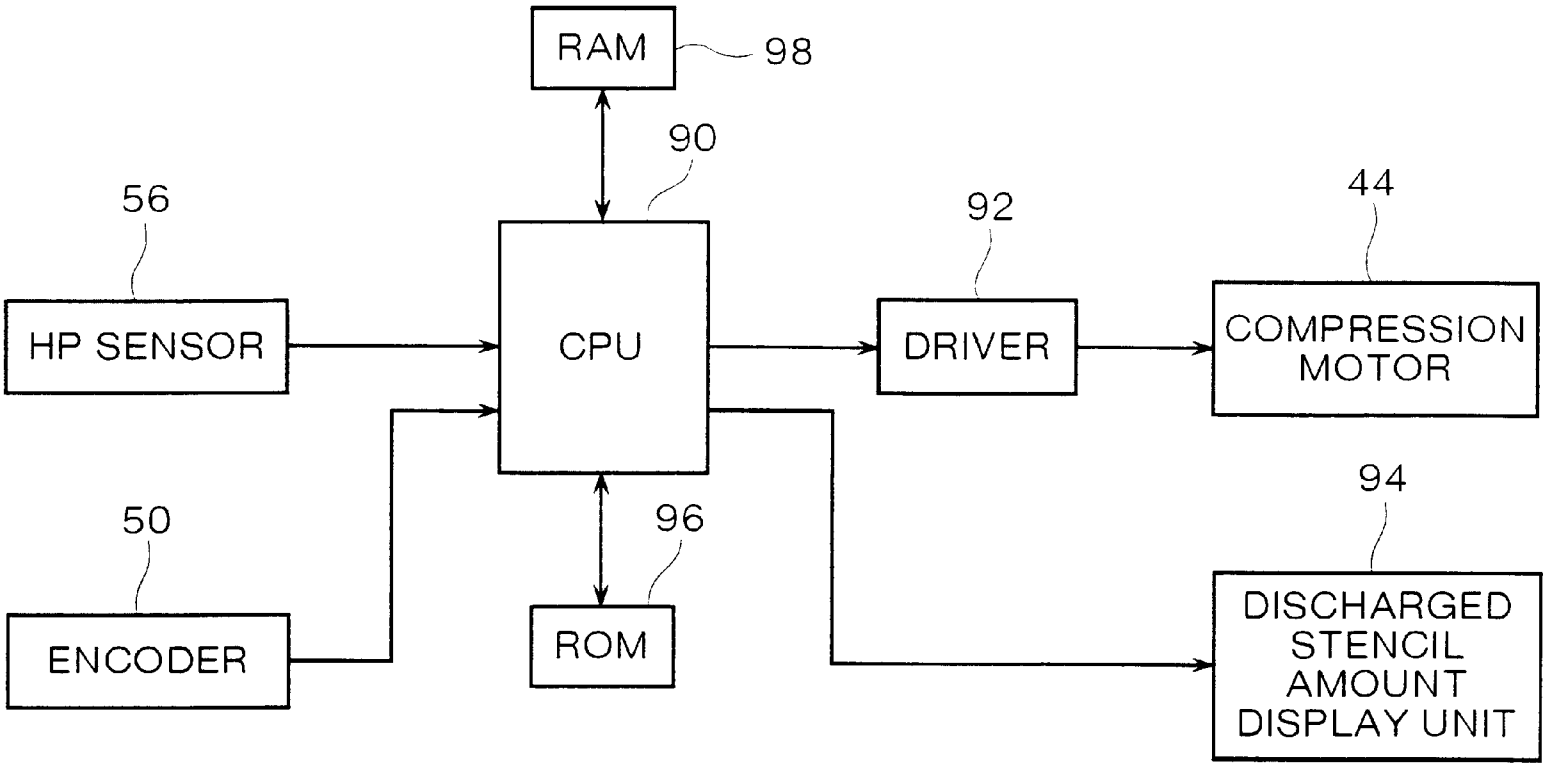
FIG. 3 is a block diagram for showing a control system for controlling the discharged stencil sheet unit shown in FIG. 2.

FIG. 3 is a block diagram for showing a control system for controlling the stencil sheet discharging unit 40 having the aforesaid configuration. In this figure, a central processing unit (CPU) 90 totally controls an entire stencil printing machine. The CPU 90 controls the compression motor 44 through a driver 92 in response to the input signals from the encoder 50 and the HP sensor 56 and further controls the content of display at the display unit 94 for residual amount of discharged stencil sheet. The CPU 90 performs giving and receiving of the program or various kinds of data between the read-only-memory (ROM) 96 and a random-accessmemory (RAM) 98. In ROM 96 are stored the discharged stencil sheet processing programs or various kinds of set data to be described later.

Figure 4:
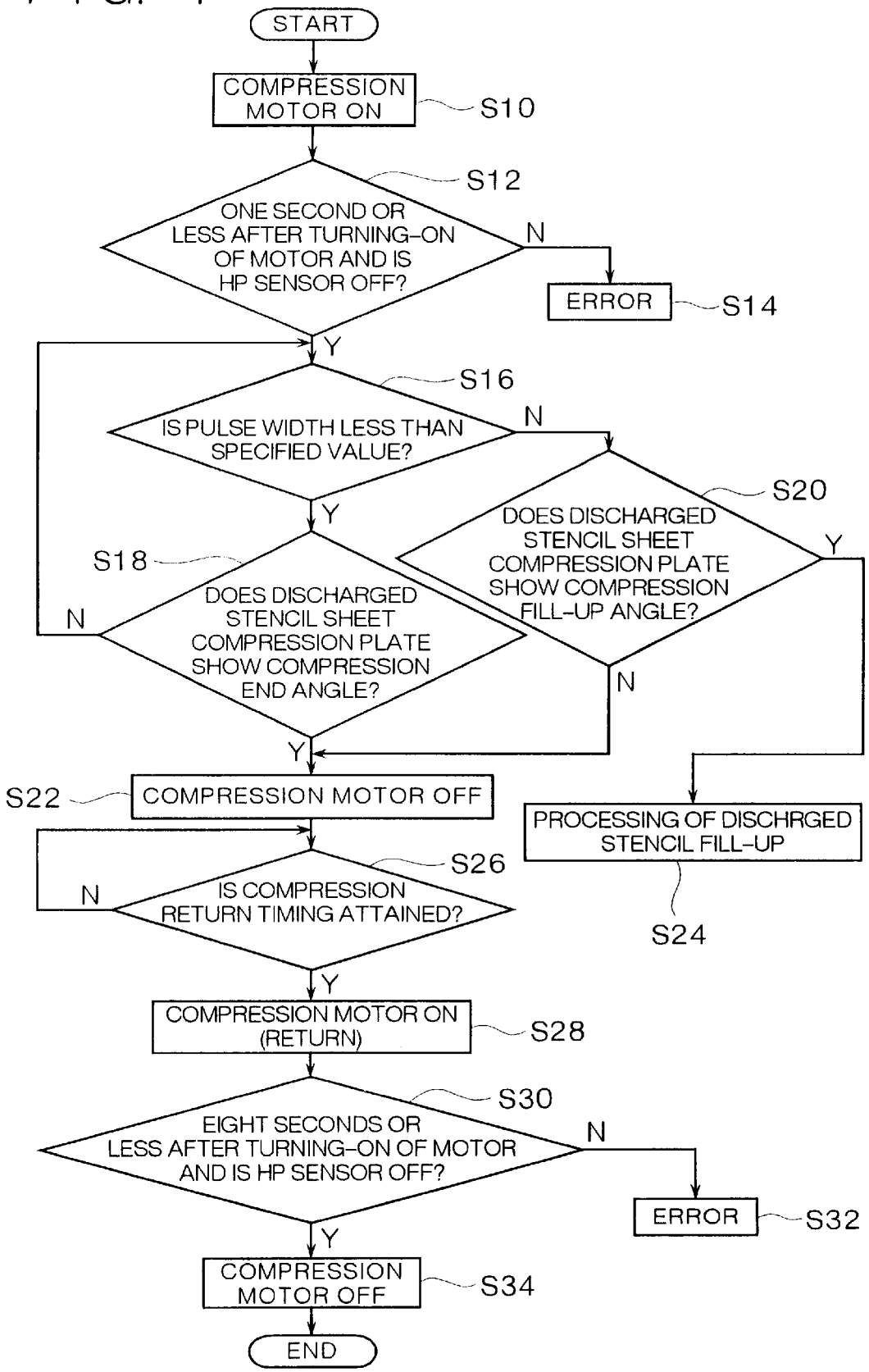
FIG. 4 is a flow chart for indicating a processing content of CPU shown in FIG. 3.

FIG. 4 is a flow-chart for indicating the content of processing at the CPU 90. When transferring of the stencil sheet 22 separated from the printing drum 31 into the discharged stencil sheet box 42 is completed by the discharged stencil sheet feeding means 41, the compression motor 44 is driven and the compressing operation is started (a step S10). Before starting the compressing operation, the discharged stencil sheet compression plate 43 is positioned at the home position indicated in FIG. 2.

When the discharged stencil sheet compression plate 43 is positioned at the home position, the home position sensor 56 is turned ON. After the compression motor 44 is driven, it is discriminated whether or not the home position sensor 56 is changed over from its ON state to its OFF state within 1 second (a step S12). In the case that the home position sensor is not turned OFF within 1 second, it is discriminated that an abnormal state occurred and then the compression motor 44 is stopped or error processing such as an error display or the like is performed (a step S14).

Figure 5:
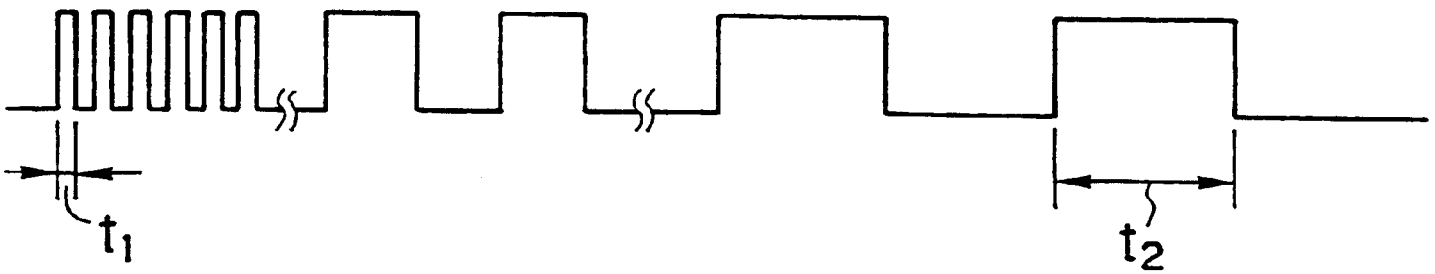
FIG. 5 is a view for showing a state in which the pulse width of the pulse outputted from the encoder shown in FIG. 2 is changed in response to a load.

When the home position sensor 56 is turned OFF within 1 second, subsequently it is discriminated whether or not the pulse width of the pulse to be inputted from the encoder 50 is within the predetermined value (a step S16). That is, as shown in FIG. 5, the pulse width of the pulse outputted from the encoder 50 is increased in response to a load (a compression force) of the discharged stencil sheet compression plate 43. A pulse width t1 when the discharged stencil sheet compression plate 43 does not compress the discharged stencil sheet 22 but is merely driven is about 0.1 second, for example. In addition, a pulse width t2 when a predetermined compression force is added to the discharged stencil sheet 22 is about 1 second, for example.

Accordingly, under a form in which a pulse width of pulse outputted from the encoder 50 is lower than the predetermined value (1 second in this preferred embodiment), the operation proceeds to a step S18. In turn, when a pulse width exceeds 1 second, the operation advances to a step S20.

At the step S18, it is discriminated whether or not the discharged stencil sheet compression plate 43 shows a compression end angle. That is, the CPU 90 has a counter, the number of pulses to be inputted from the encoder 50 is counted by this counter, thereby the moving position (angle) of the discharged stencil sheet compression plate 43 is detected. In this preferred embodiment, if the angle when the discharged stencil sheet compression plate 43 is positioned at the home position is defined as 0°, the compression end angle is set to 110°. The counted value (the number of pulses) corresponding to this compression end angle is 154. In the case that the discharged stencil sheet compression plate 43 is positioned at the home position, the counted value in the counter of the CPU 90 is reset to 0.

Then, in the case that the number of discharged stencil sheets 22 in the discharged stencil sheet box 42 is less, the discharged stencil sheet compression plate 43 reaches up to the compression end angle before a predetermined compression force is added to the discharged stencil sheet 22 and in this case, the operation advances to a step S22 and the compression motor 44 is stopped.

In turn, at a step S20, it is discriminated whether or not the discharged stencil sheet compression plate 43 shows a compression fill-up angle. In this preferred embodiment, as the compression fill-up angle, there are provided a standard 35° (the number of pulses=49) and a less angle of 42° (the number of pulses=59), and they can be properly selected in response to a user mode.

In the case that the discharged stencil sheet compression plate 43 shows a compression fill-up angle, the discharged stencil sheet fill-up processing operation is executed (a step S24). In the case that the discharged stencil sheet compression plate 43 does not show a compression fill-up angle, the operation advances to a step S22 and the compression motor 44 is stopped.

Then, it is discriminated whether or not a compression plate return timing is attained (a step S26). This compression plate return timing is a timing where a specified period of time (for example, 2 seconds) elapses after the compression motor 44 is stopped at the step S22. A reason why the compression motor 44 is stopped for a specified period of time under a state in which the discharged stencil sheet 22 is compressed consists in attaining a positive compression of the discharged stencil sheet 22.

Upon reaching the compression plate return timing, the compression motor 44 is driven in inverse direction in order to return the discharged stencil sheet compression plate 43 to the home position (a step S28). Then, after the compression motor 44 is driven in an inverse direction, it is discriminated whether or not the home position sensor 56 is turned ON within 8 seconds (a step S30). In the case that the home position sensor 56 is not turned ON within 8 seconds, it is discriminated that an abnormal state is generated and the error processing is carried out (a step S32). In the case that the sensor is turned ON within 8 seconds, the compression motor 44 is stopped at that time (a step S34) and the compressing operation is completed.

Some set data such as the number of pulses corresponding to the compression end angle (=154), the number of pulses corresponding to the compression fill-up angle (standard/less)(=49/59) and the compression plate return timing (=2 seconds) and the like are already written in ROM 96. In addition, the set data can be re-writable in reference to a test mode.

Figure 6:
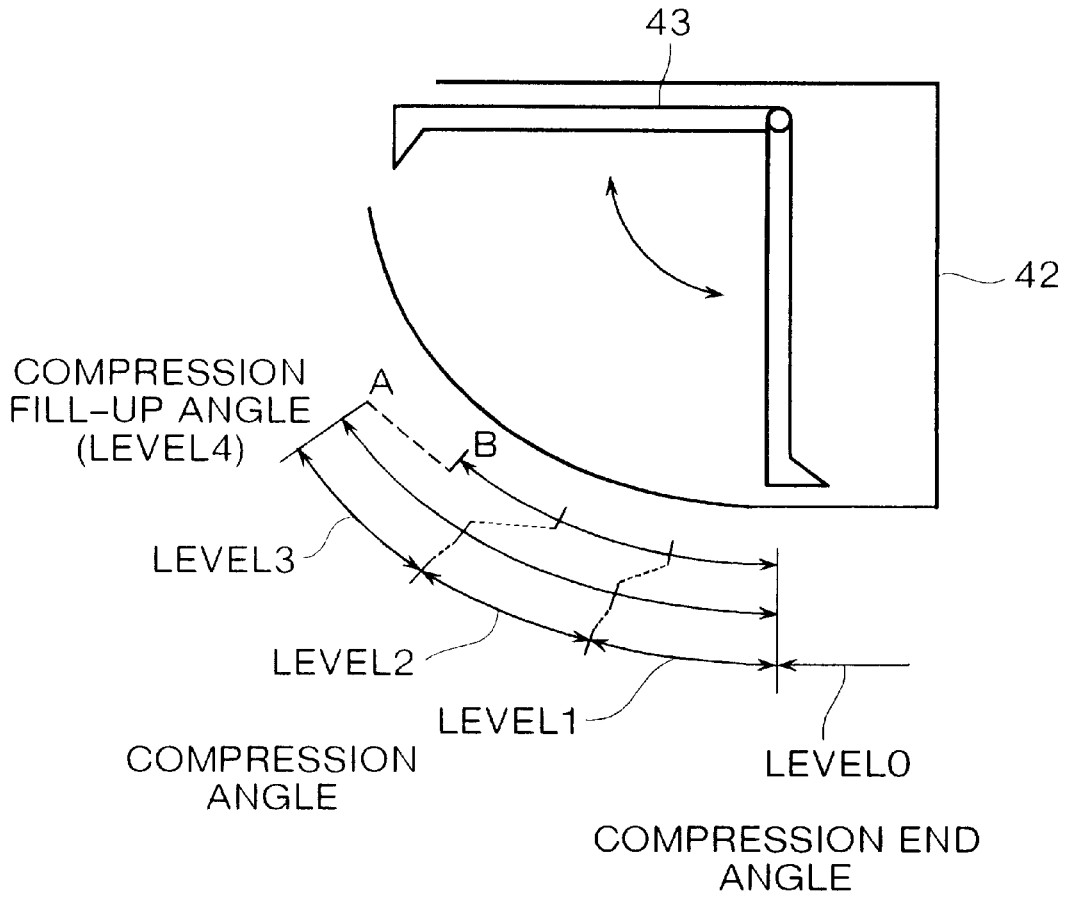
FIG. 6 is a view for illustrating a setting of the levels 0 to 4 indicating the residual amount of discharged stencil sheets in response to the compression fill-up angles A/B (standard/less).

Then, a display control for the display unit 94 for residual amount of discharged stencil sheet shown in FIG. 3 will be described as follows. As shown in FIG. 6, when the compression fill-up angle A/B (standard/less) is selected, levels 0 to 4 indicating the residual amount are set in response to either the compression fill-up angle A or B selected.

That is, the level 0 is a range of angle more than the compression end angle. The levels 1 to 3 correspond to each of the angle ranges where an angle from the compression end angle to the compression fill-up angle is divided into three sections.

The level 4 corresponds to a range of angle less than a compression fill-up angle. Then, an angle of the discharged stencil sheet compression plate 43 can be detected in reference to the number of pulses generated from the encoder 50 and it becomes apparent to what level the residual amount of discharged stencil sheet correspond in response to the angle.

Figure 7:
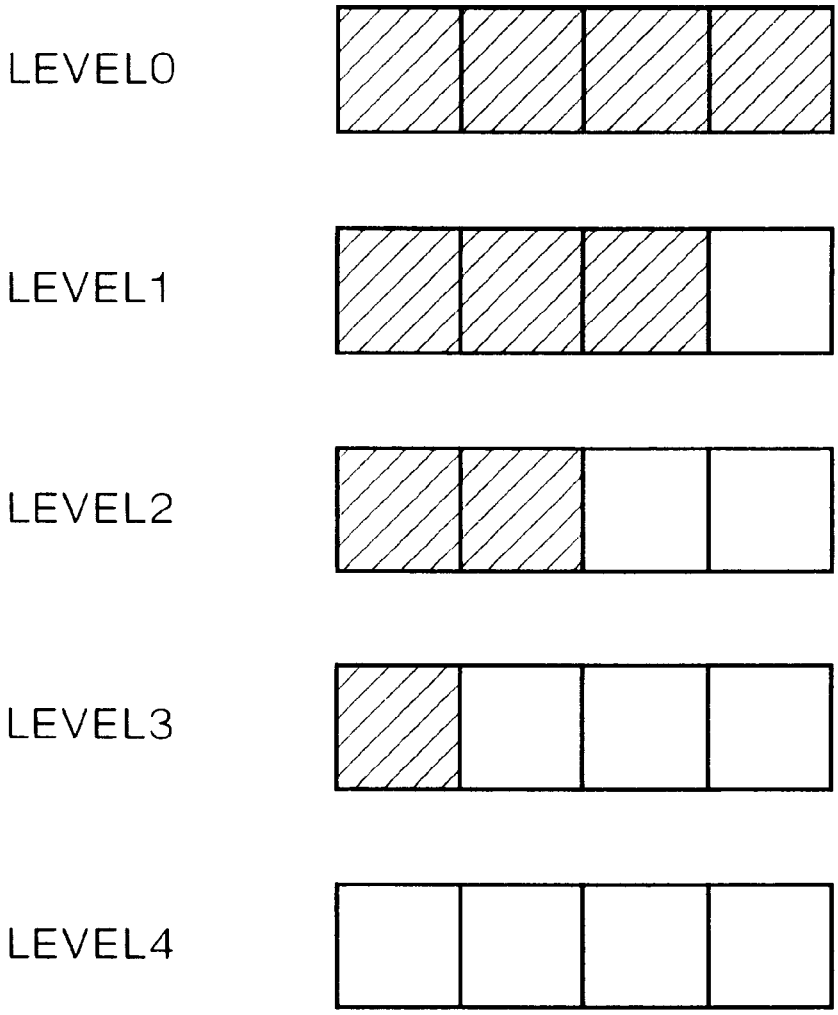
FIG. 7 is a view for indicating the displayed content at the display section of the discharged stencil sheet residual amount display unit shown in FIG. 3.
Figure 8:
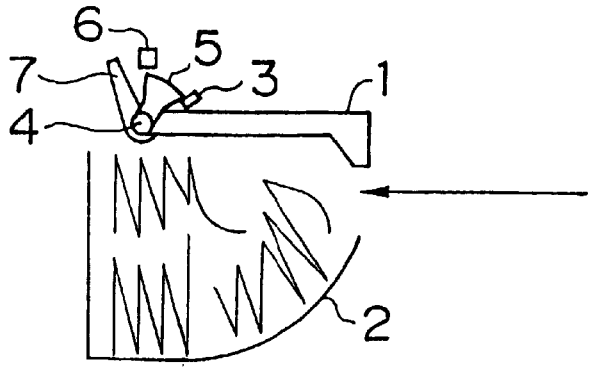
FIG. 8 (A) Prior Art
FIGS. 8A to 8D are views applied for illustrating an operation of the discharged stencil sheet compression plate of the stencil sheet discharging device of the prior art.
Figure 8:
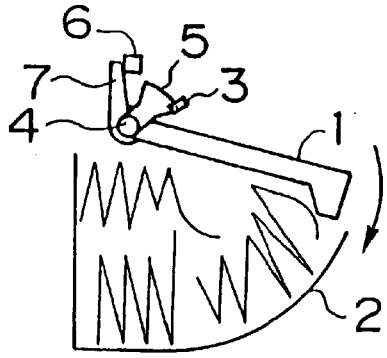
FIG. 8 (B) Prior Art
Figure 8:
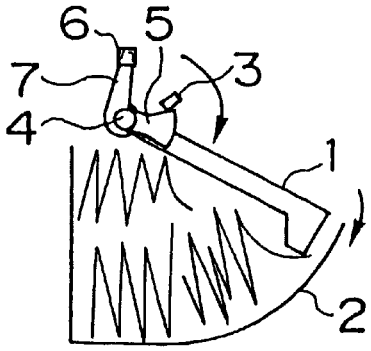
FIG. 8 (C) Prior Art
Figure 8:
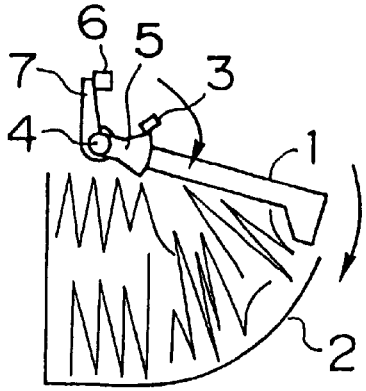
FIG. 8 (D) Prior Art

FIG. 7 is a view for showing the display unit 94 for residual amount of the discharged stencil sheets and it indicates the content of display corresponding to each of the levels 0 to 4 illustrated in FIG. 6. That is, as shown in FIG. 7, a range indicated by a shaded line at the display unit 94 corresponds to the residual amount of discharged stencil sheets (a vacant capacity where the stencil sheet can be discharged). Displaying at the display unit 94 is a scale for discriminating what degree is present for the residual amount of the discharged stencil sheet in respect to the discharged stencil sheet fill-up state.

In the preferred embodiment, although the residual amount of discharged stencil sheet is displayed in graphics, it may not be limited to this state, for example, it may be displayed with numerical values such as 4/4, 3/4, 2/4, 1/4 and 0/4.

In addition, the position (angle) of the discharged stencil sheet compression plate 43 is detected by counting the number of pulses generated from the encoder 50. It may also be applicable that it is not limited to this value, but an absolute encoder is arranged at the supporting shaft 48 of the discharged stencil sheet compression plate 43 and the absolute position of the discharged stencil sheet compression plate 43 is detected by this absolute encoder. Further, the discharged stencil sheet compression plate 43 is not limited to the rotary type, but it may be a direct driving type.

As described above, in accordance with the present invention, it is possible that a moving amount of the discharged stencil sheet compression plate is detected, a residual amount of the discharged stencil sheet box is displayed in response to the moving amount and the time when the fill-up state can be attained is estimated. In addition, since the discharged stencil sheet is compressed with the predetermined compression force for every sheet, a superior compression can be carried out and much amount of discharged sheets can be stored in the discharged stencil sheet box.

In addition, since the encoder for detecting the moving amount of the discharged stencil sheet compression plate is utilized and the compression force of the discharged stencil sheet compression plate is detected in response to the pulse width of the pulse generated from the encoder, the cost of the sensor can be reduced.

Further, the present invention has some advantages that the compression filled position in the discharged stencil sheet box can be set easily and the display means can display the residual amount in response to the set filled position.

What is claimed is:

1. A stencil sheet discharging device for a stencil printing machine comprising:

a discharged stencil sheet compression plate for use in compressing a discharged stencil sheet fed into a discharged stencil sheet box within the discharged stencil sheet box;

a driving means for driving said discharged stencil sheet compression plate and compressing the discharged stencil sheet within said discharged stencil sheet box;

a compression force detecting means for sensing that a predetermined compression force is added to said discharged stencil sheet;

a control means for stopping a compressing operation performed by said driving means when a predetermined compression force is detected by said compression force detecting means;

a moving amount detecting means for detecting a moving amount of said discharged stencil sheet compression plate when a predetermined compression force is detected by said compression force detecting means; and a display means for displaying a residual amount in said discharged stencil sheet box in reference to a moving amount detected by said moving amount detecting means.

2. The stencil sheet discharging device for a stencil printing machine according to claim 1, wherein:

there is provided a setting means for setting a compression fill-up position of said discharged stencil sheet box, and said display means displays the residual amount in said discharged stencil sheet box in response to the compression fill-up position set by said setting means and the moving amount detected by said moving amount detecting means.

3. The stencil sheet discharging device for a stencil printing machine according to claim 1, wherein:

said control means controls said driving means so that said discharged stencil sheet compression plate is operated to compress the discharged stencil sheet within said discharged stencil sheet box until the predetermined compression force is detected by said compression force detecting means, said discharged stencil sheet compression plate is stopped at the compressing position for a predetermined period of time in case where the predetermined compression force is detected by said compression force detecting means, and said discharged stencil sheet compression plate is returned back to a home position of the discharged stencil sheet compression plate.

4. A stencil sheet discharging device for a stencil printing machine comprising:

a discharged stencil sheet compression plate for use in compressing a discharged stencil sheet fed into a discharged stencil sheet box within said discharged stencil sheet box;

a driving means for driving said discharged stencil sheet compression plate and compressing the discharged stencil sheet within said discharged stencil sheet box;

an encoder for generating the number of pulses corresponding to a moving amount of said discharged stencil sheet compression plate;

a compression force detecting means for detecting a pulse width of pulse generated from said encoder and detecting that a predetermined compression force is added to the discharged stencil sheet when said pulse width exceeds a predetermined value;

a control means for stopping a compressing operation performed by said driving means when a predetermined compression force is detected by said compression force detecting means;

a moving amount detecting means for counting pulses generated from said encoder until a predetermined compression force is detected by said compression force detecting means and detecting a moving amount of said discharged stencil sheet compression plate in response to the counted number of pulses; and a display means for displaying a residual amount in said discharged stencil sheet box in reference to a moving amount detected by said moving amount detecting means.

5. The stencil sheet discharging device for a stencil printing machine according to claim 4, wherein:

there is provided a home position sensor for use in sensing a home position of said discharged stencil sheet compression plate, and said moving amount detecting means either resets or pre-sets a number of pulses to be counted when said home position sensor detects the home position of said discharged stencil sheet compression plate.

6. The stencil sheet discharging device for a stencil printing machine according to claim 5, wherein:

there is provided a setting means for setting a compression fill-up position of said discharged stencil sheet box, and said display means displays the residual amount in said discharged stencil sheet box in response to the compression fill-up position set by said setting means and the moving amount detected by said moving amount detecting means.

7. The stencil sheet discharging device for a stencil printing machine according to claim 5, wherein:

said control means controls said driving means so that said discharged stencil sheet compression plate is operated to compress the discharged stencil sheet within said discharged stencil sheet box until the predetermined compression force is detected by said compression force detecting means, said discharged stencil sheet compression plate is stopped at the compressing position for a predetermined period of time in case where the predetermined compression force is detected by said compression force detecting means, and said discharged stencil sheet compression plate is returned back to the home position.

8. The stencil sheet discharging device for a stencil printing machine according to claim 4, wherein:

there is provided a setting means for setting a compression fill-up position of said discharged stencil sheet box,and said display means displays the residual amount in said discharged stencil sheet box in response to the compression fill-up position set by said setting means and the removing amount detected by said moving amount detecting means.

9. The stencil sheet discharging device for a stencil printing machine according to claim 4, wherein:

said control means controls said driving means so that said discharged stencil sheet compression plate is operated to compress the discharged stencil sheet within said discharged stencil sheet box until the predetermined compression force is detected by said compression force detecting means, said discharging stencil sheet compression plate is stopped at the compressing position for a predetermined period of time in case where the predetermined compression force is detected by said compression force detecting means, and said discharge stencil sheet compression plate is returned back to a home position of the discharged stencil sheet compression plate.

* * * * *